United States Patent [19]

Heckmann et al.

[11] Patent Number: 4,464,163

[45] Date of Patent: Aug. 7, 1984

[54] SEPARATOR

[75] Inventors: Wolfgang Heckmann, Bergisch Gladbach; Karl Koslowski, Hamminkeln, both of Fed. Rep. of Germany

[73] Assignee: Klockner-Humboldt-Deutz AG, Fed. Rep. of Germany

[21] Appl. No.: 341,277

[22] Filed: Jan. 21, 1982

[30] Foreign Application Priority Data

Jan. 21, 1981 [DE] Fed. Rep. of Germany ..... 3101713

[51] Int. Cl.[3] ..... B04B 7/04

[52] U.S. Cl. ..... 494/64

[58] Field of Search ..... 494/38, 64, 67, 68; 411/383, 385, 396, 397

[56] References Cited

U.S. PATENT DOCUMENTS

| | | | |
|---|---|---|---|
| 2,403,089 | 7/1946 | Lars | 494/68 |
| 2,483,342 | 9/1949 | Henrard | 494/68 |
| 3,463,388 | 8/1969 | Salmon | 494/38 |
| 3,659,490 | 5/1972 | Buck | 411/383 |
| 4,253,509 | 3/1981 | Collet | 411/383 |

*Primary Examiner*—Philip R. Coe
*Assistant Examiner*—Michael Knick
*Attorney, Agent, or Firm*—Hill, Van Santen, Steadman & Simpson

[57] ABSTRACT

A centrifuge rotor includes a dynamically balanced casing assembly having upper and lower parts that define a hollow bowl with a continuous peripheral gap between such casing parts. The casing parts are held in position by a series of bolt assemblies which maintain the axial spacing. Each bolt assembly has a pair of portions respectively, rigidly secured to the casing parts, such bolt assembly portions having concentric interfitting surfaces, with a screw extending through one of said bolt assembly portions into the other. The concentric interfitting surfaces preferably include a step whereby precise location of the casing parts with respect to each other is achieved, even upon reassembly, thereby facilitating disassembly and reassembly as well as assuring maintenance of dynamic balance.

7 Claims, 2 Drawing Figures

SEPARATOR

BACKGROUND OF THE INVENTION

1. Field of the Invention

This invention relates to a centrifuge of the continuous peripheral discharge type employing a disc-bowl assembly as a rotor.

2. Prior Art

On occasion it becomes necessary to disassemble a dynamically balanced centrifuge rotor, such as for service. Certain constructions of centrifuge rotor are so made that disassembly and reassembly are not easily carried out. Further, on reassembly, owing to small relative displacements in position, initial dynamic balance has not always been reachieved, a condition which produces unbalance forces at operating speeds, namely a condition that cannot be tolerated.

SUMMARY OF THE INVENTION

The invention comprises a centrifuge wherein the rotor casing parts are connected to one another by means of bolt assemblies which are arranged as spacers in the peripheral area thereof and are uniformly distributed in the circumferential direction. More specifically, each bolt assembly is constructed in two parts and are connected together by means of a screw. By means of such construction, the two rotor parts can be readily separated and reassembled with each other and on reassembly are connected to one another with such precision relative to the rotational axis that no significant unbalance force occurs during the operation of the separator or centrifuge. With this arrangement, the loss of bowl space found in separators with a central connecting column is avoided.

Accordingly, it is an object of the present invention to provide a centrifuge rotor which can be readily disassembled and reassembled.

Another object of the present invention is to provide a casing assembly for a centrifuge rotor which is dynamically balanced, wherein the dynamic balance is restored, even if the dynamically balanced casing assembly has been disassembled.

Many other advantages, features and additional objects of the present invention will become manifest to those versed in the art upon making reference to the detailed description and the accompanying sheet of drawings in which a preferred structural embodiment incorporating the principles of the present invention is shown by way of illustrative example.

ON THE DRAWINGS

Figure 2:
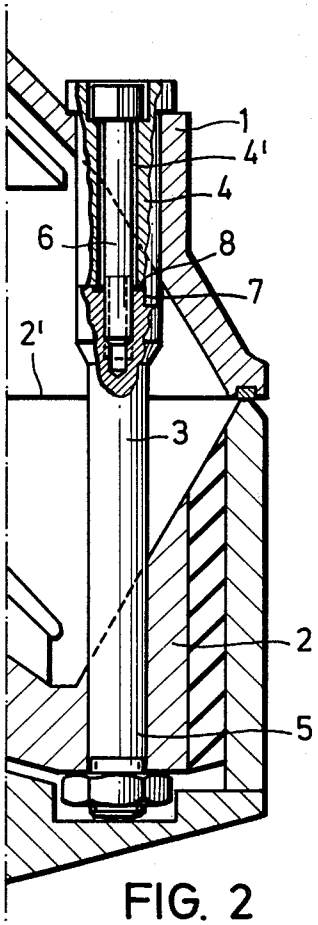
Figure 1:
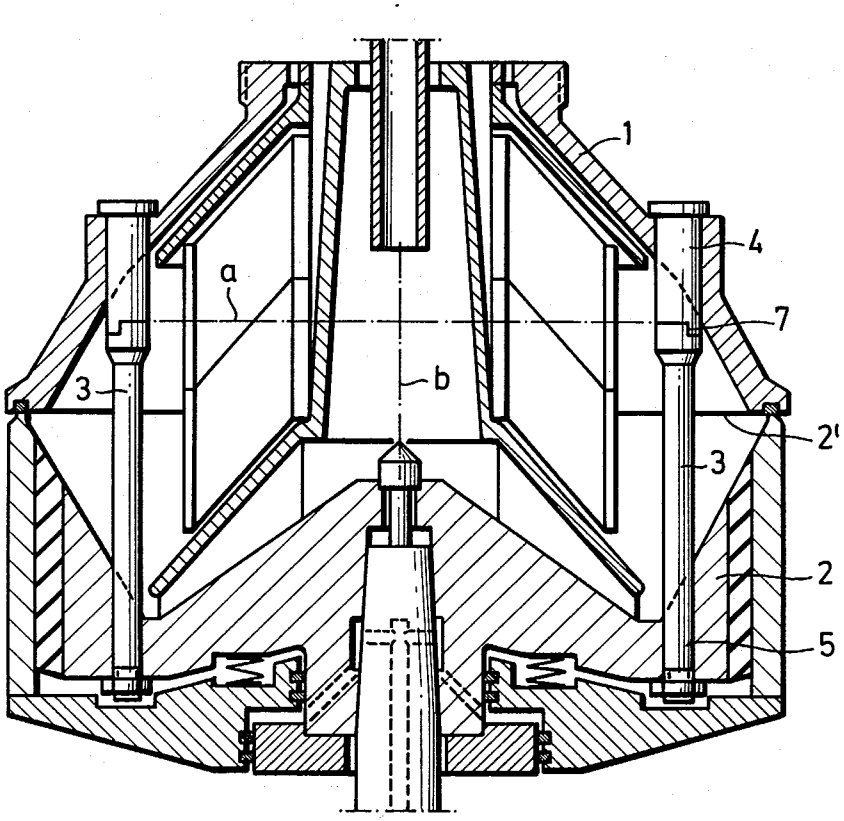

FIG. 1 is a vertical cross-section of a centrifuge rotor provided in accordance with the principles of the present invention; and FIG. 2 is an enlarged fragmentary view of a portion of FIG. 1.

AS SHOWN ON THE DRAWINGS

As shown in FIG. 1, a centrifuge rotor has a bowl defined by the frusto-conical innersurfaces of a first upper rotor casing part 1, and of a second rotor casing part 2. The upper edge of the rotor casing part 2 and the lower edge of the upper rotor casing part 1 jointly define a continuous peripheral gap 2' through which separated solids are discharged. Although the continuous peripheral gap 2' between the casing parts 1, 2 is continuous and is fixed in axial extent, as a practical matter, a movable cup-like valve surrounds the lower rotor casing part 2 as shown for regulating the functional magnitude of the gap in a known manner, for example like that shown in U.S. Pat. No. 3,823,868.

In accordance with the invention, centrifuge rotor casing parts, namely the upper part 1 and the lower part 2 are connected to one another by means of a series of bolt assemblies 3 which maintain the axial spacing of the casing parts 1, 2. They also maintain the casing parts in concentric relation to each other and with respect to the rotational axis. Although only two bolt assemblies 3 are illustrated, there is actually a series of them that are disposed in equally spaced relation to each other on a bolt circle that encircles the rotational axis at a point that is radially spaced inwardly from the gap 2'. With this location, they do not interfere with the function of the continuous gap.

Each bolt assembly 3 includes an upper portion 4 secured to the first casing part 1 and a separate lower portion 5 secured to the second casing part 2. The portions 4 and 5 are respectively snugly carried, and such snug fit is provided by means of a press fit or its equivalent, such as a weld. At any event, there is absolutely no possible relative movement between the bolt assembly portions 4, 5 and the casing parts 1, 2, respectively.

As best shown in FIG. 2, the upper bolt portion 4 is axially hollow and thus has a bore 4' through which a screw 6 extends. The lower portion 5 is threaded at its upper end to receive threads of the screw 6.

The lower end of the upper portions 4 and the upper end of the lower portions 5 have concentric interfitting surfaces generally indicated by the reference numeral 7. The interfitting surfaces at 7 lie in a pair of spaced horizontal planes, one of which is indicated at a, such planes extending perpendicularly to the rotational axis b. Further, between the concentric interfitting surfaces, there is a seal 8 which keeps contaminantes away from the threads of the screw 6. With this arrangement, the upper and lower portions 4, 5, respectively being held firmly and rigidly by the casing parts 1, 2, on assembly are nested together in a precise manner to accurately bring the casing parts 1, 2 into true concentric dynamically balanced relation.

By means of the novel construction of the bolt assemblies 3, the rotor parts 1, 2 can be connected to one another with such precision, with respect to the rotational axis, that no significant unbalance force occurs during operation of the centrifuge, even at extremely high speeds. Yet, the arrangement is such that the casing assembly can be easily disassembled and reassembled. The arrangement is such that the threads of the screws 6 are protected against external influences such as incrustation, or the like so that they can be easily and quickly removed at any time and screwed back in. The step-shape of the interfitting surfaces provides both accurate axial and accurate radial relative location of the casing assembly parts. The seal 8 reliably prevents any penetration of liquid into the longitudinal bore 4' or emergence through the upper end of such bore.

Although various minor modifications may be suggested by those versed in the art, it should be understood that we wish to embody within the scope of the patent warranted hereon, all such embodiments as reasonably come within the scope of our contribution to the art.

We claim as our invention:

1. A centrifuge rotor of the disc-bowl type having a dynamically balanced casing assembly, said assembly comprising:

a first and a second rotor casing part, said parts being hollow to define the bowl, and each having a frustoconical inner wall spaced from each other and respectively leading to a continuous peripheral gap between said parts for the discharge of separated solids; and a series of bolt assemblies secured to said casing parts and holding said casing parts in axially spaced relation to each other, said bolt assemblies being disposed in equally spaced relation on a bolt circle lying radially inwardly from said continuous peripheral gap, each of said bolt assemblies having an upper portion snugly carried by said first casing part, a separate lower portion snugly carried by said second casing part, said portions being concentrically joined together within said bowl;

whereby on re-assembly, said bolt assemblies will reestablish the dynamic balance.

2. A centrifuge rotor according to claim 1, said portions of said bolt assemblies having concentric axially separable interfitting surfaces, one of said portions being axially hollow and the other having screw threads, and a screw extending through said one portion into said other portion.

3. A centrifuge rotor according to claim 2, said concentric interfitting surfaces each lying at least in part in two spaced planes perpendicular to the rotor's axis, whereby said concentric interfitting surfaces are step-shaped.

4. A centrifuge rotor according to claim 3, including an annular seal for each bolt assembly and disposed at one of said planes for blocking fluid communication from the hollow bowl to said screw.

5. A centrifuge rotor according to claim 2, said screw extending through the upper one of said bolt portions.

6. A centrifuge rotor according to claim 1, said upper and lower portions having press fits with said first and second casing parts.

7. A centrifuge rotor according to claim 1, said upper and lower portions being welded to said first and second casing parts respectively.

* * * * *